United States Patent [19]

Schmolke et al.

[11] 4,438,547

[45] Mar. 27, 1984

[54] CARDING ELEMENT FOR A CARDING MACHINE

[75] Inventors: Karl H. Schmolke, Neuweiler; Joachim Finsterbusch, Backnang; Walter Loffler, Neubulach, all of Fed. Rep. of Germany

[73] Assignee: Hollingsworth GmbH, Fed. Rep. of Germany

[21] Appl. No.: 363,335

[22] Filed: Mar. 29, 1982

[30] Foreign Application Priority Data

Mar. 30, 1981 [DE] Fed. Rep. of Germany ..... 3112491
Oct. 28, 1981 [DE] Fed. Rep. of Germany ..... 3142780

[51] Int. Cl.[3] ..... D01G 15/24; D01G 15/88

[52] U.S. Cl. ..... 19/98; 19/113; 19/114

[58] Field of Search ..... 19/104, 113, 114, 105, 19/98

[56] References Cited

U.S. PATENT DOCUMENTS

| | | | |
|---|---|---|---|
| 3,793,677 | 2/1974 | Bechtel | 19/113 |
| 4,287,643 | 9/1981 | Leifeld | 19/114 |

FOREIGN PATENT DOCUMENTS

| | | | |
|---|---|---|---|
| 2918210 | 11/1980 | Fed. Rep. of Germany | 19/113 |
| 652953 | 3/1929 | France | 19/114 |
| 2096192 | 10/1982 | United Kingdom | 19/114 |

*Primary Examiner*—Louis Rimrodt
*Attorney, Agent, or Firm*—Townsend & Townsend

[57] ABSTRACT

In a carding machine having cylinders, which are provided with a clothing of a saw-tooth wire helically wound thereon, carding elements are provided having saw-tooth wire sections, which are arranged at an acute angle to a plane that is transverse to the axis of rotation of the cylinders.

6 Claims, 5 Drawing Figures

CARDING ELEMENT FOR A CARDING MACHINE

BACKGROUND OF THE INVENTION

The invention relates to a carding element which comprises a support and a plurality of saw-tooth wire sections arranged parallel to one another on said support, for use in a carding machine having a carding cylinder, a saw-tooth wire helically wound around said cylinder, and at least one carding element cooperating with said cylinder.

Such carding elements are well-known in the art. They comprise saw-tooth wire section, which are each arranged in a plane that coincides with a diameter plane of said cylinder. The term diameter plane is intended to designate a plane that is perpendicular to the axis of the cylinder. The main advantage of such carding machines resides in a better quality of the carded fibres and in a more uniform parallel arrangement of the fibres in the web. However, it has been found that in treating mixtures of fibers consisting of cotton on the one hand and synthetic fibres on the other hand or synthetic fibres of different denier, no uniform mixture of the different fibres could be attained. When carding a mixture of an equal amount of cotton fibres and polyester fibres, these different types of fibres tended to separate and lead to a non-uniform composition of the fibre web.

BRIEF SUMMARY OF THE INVENTION

It is an object of the invention to provide a carding element that leads to a more uniform and homogeneous fibre web and a better parallel arrangement of the fibres.

These objects are achieved in that at least one carding element has its saw-tooth wire sections arranged at an angle or obliquely to a diameter plane of a coordinated cylinder.

When using such a carding element for cooperation with a lickerin of a carding device, the saw-tooth wire sections of the same may preferably be tilted opposite to the direction of pitch of the saw-tooth wire clothing of the licker-in. By this, the fibres are pre-carded, a better separation of trash is achieved and the slip of the fibres in the licker-in area is reduced.

When using a plurality of carding elements in cooperation with the main cylinder of a carding device, it is preferable that the direction of pitch of the saw-tooth wire segments in successive carding elements alternates. Thus, the carding results are further improved. It is also advantageous to provide the saw-tooth wire segments of the first carding elements with a direction of pitch that is opposite to the direction of pitch of the saw-tooth wire which is wound around the main cylinder.

Although the pitch of the saw-tooth wire segments of a carding element may equal the pitch of the saw-tooth wire wound on a coordinated cylinder, it is generally preferable to position the saw-tooth wire segments of the carding elements with a pitch that is different from the pitch of the saw-tooth wire on the cylinder.

According to another embodiment, which is preferable for licker-in rolls, adjacent saw-tooth wire sections are held in a distance from one another by the insertion of profiled wire sections, which are void of teeth.

It has been found that the carding results are best if the pitch of the saw-tooth wire sections is dimensioned such that the beginning of each of said saw-tooth wire sections and the end of an adjacent saw-tooth wire section lie within the same diameter plane. By this, a more uniform carding effect is achieved, since a non-uniform distribution of the teeth in a direction transverse to the fibre flow is avoided.

The entity of the saw-tooth wire sections of a carding element may be fixed by end plates, which may also serve to adjust the pitch of the same.

BRIEF DESCRIPTION OF THE DRAWINGS

The present invention will be more fully described when taken in conjunction with the accompanying drawings, wherein.

DETAILED DESCRIPTION OF A PREFERRED EMBODIMENT

Figure 1:
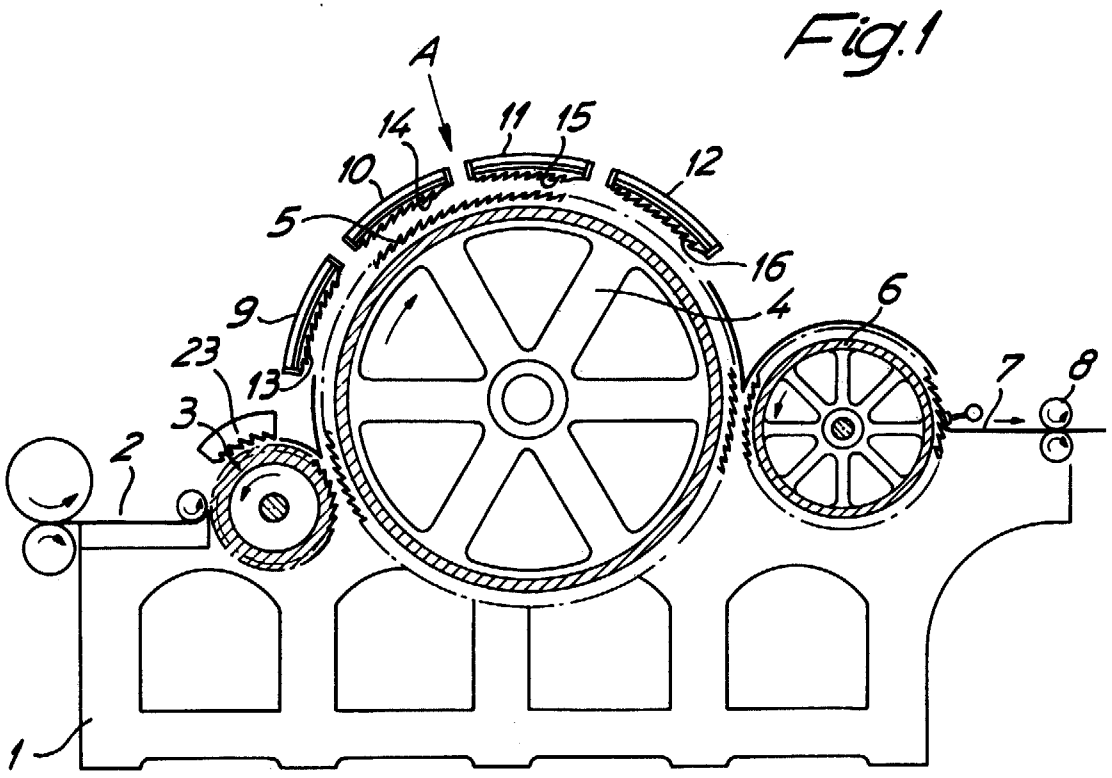
FIG. 1 is a side elevational view of a carding device incorporating the present invention.

Referring to FIG. 1, there is shown a carding machine, in which a feed device 2 is provided having a feed table cooperating with a plurality of rollers. The feed device is followed by a licker-in 3. In the upper region of the licker-in a carding element 23 is positioned for coopration therewith.

The licker-in 3 is followed by a main cylinder 4. Opposite the licker-in 3 a doffing cylinder is arranged to take over the fibres from the main cylinder. The fibre web leaving the doffing cylinder 6 is supported by a table 7 and then presented to calendar rolls 8.

The direction of rotation of the individual cylinders and rolls is indicated by arrows.

In the upper region of the main cylinder 4, there are provided in a circumferential plane four successive fixed carding elements 9, 10, 11, and 12, which are covered with saw-tooth wire sections 13, 14, 15, and 16, respectively, at their surface facing the main cylinder.

The main cylinder 4 itself is clothed with a single saw-tooth wire 5 wound helically around the main cylinder. The carding elements are positioned such that a minute clearance is left between the tips of the teeth of the saw-tooth wire sections on the one hand and of the saw-tooth wire 5 of the main cylinder on the other hand.

The licker-in 3 as well as the doffing cylinder 6 each have a clothing formed of a single wire helically wound thereon.

Figure 2:
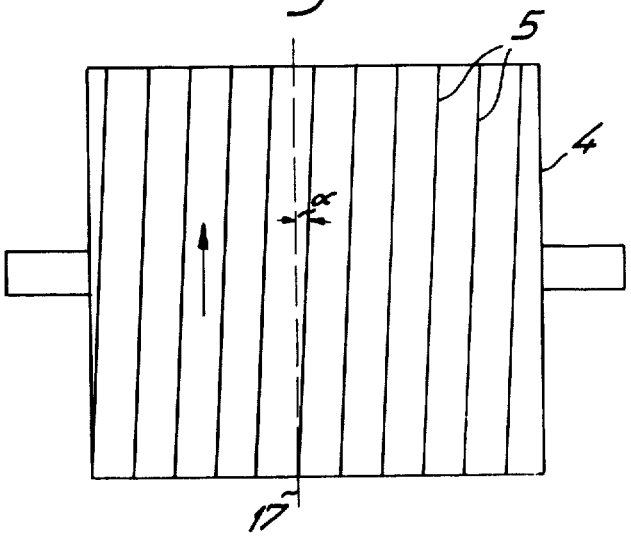
FIG. 2 is a schematic view on a main cylinder taken along the arrow A of FIG. 1.

FIG. 2 is a schematic top view on the main cylinder when viewed in the direction of the arrow A in FIG. 1. For better clarity, the pitch and the distance between adjacent windings of the saw-tooth wire 5 have been exaggerated. As may be seen from FIG. 2, the saw-tooth wire 5 has a pitch $\alpha$, which is defined by the angle formed between the saw-tooth wire 5 and a diameter plane 17.

The saw-tooth wire 5 has a pitch $\alpha$, and the direction of pitch is positive when seen in the direction of rotation of the main cylinder 4.

Figure 3:
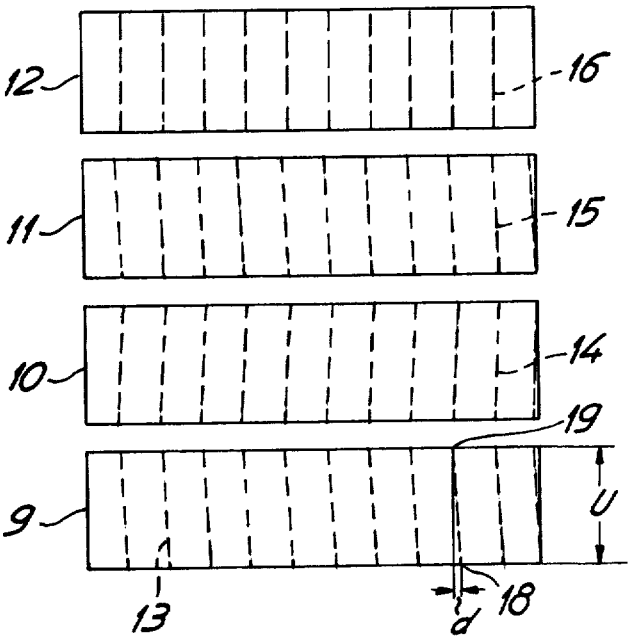
FIG. 3 is a view on the carding elements cooperating with the main cylinder when spaced apart in a tangential plane.

Form FIG. 3, which shows the four consecutive carding elements when defolded in a plane, it may be seen than the saw-tooth wire sections 13 of the first carding element 9 have a direction of pitch that is opposite to the direction of pitch of the saw-tooth wire 5 of the main cylinder 4. The pitch itself is arc $tg^{d}/_{U}$, wherein d is the axial displacement of the beginning 18 of a saw-tooth wire section 13 with reference to the end 19 of that section, and wherein U is approximately the length of the saw-tooth wire sections.

The second carding element 10 following the first carding element 9 is provided with saw-tooth wire sections 14, which are inclined in an opposite direction relative to the saw-tooth wire sections 13.

The third carding element 11 is covered with saw-tooth wire sections 15, the direction of pitch of which is the same as the direction of pitch of the saw-tooth wire sections 13 of the first carding element 9.

A fourth carding element 12 is provided, the saw-tooth wire sections 16 of which lie within diameter planes. The fourth carding element 12 is following by the doffing cylinder 6.

Figure 4:
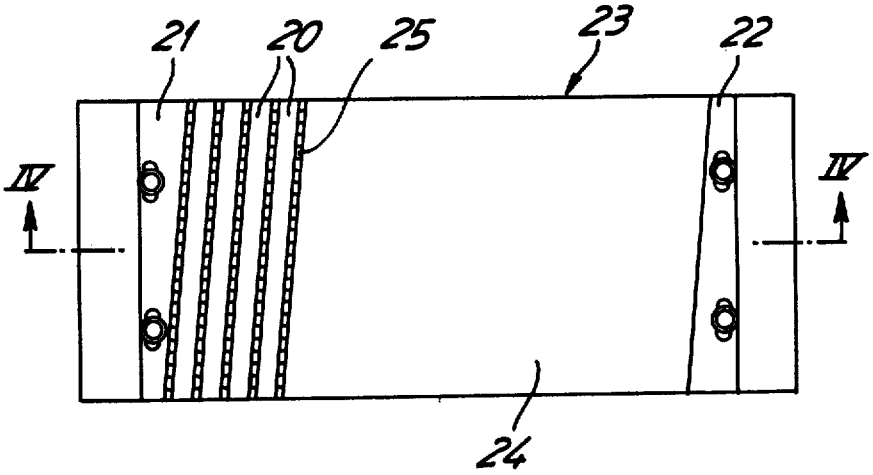
FIG. 4 is a top view on the clothing of a carding element.

FIG. 4 is a top view of the clothing of the carding element 23, that is cooperating with the licker-in 3. The carding element comprises a cylindrically curved base plate or support 24, and saw-tooth wire sections 25 are placed on the cylindrically curved surface of the base plate, toothless profiled wire sections 20 having a rectangular cross-sectional area being interposed between adjacent saw-tooth wire sections 25. The so formed clothing is firmly held together by tapered face-plates 21 and 22, which may be screwed to the base plate and adjusted so as to press together the entity of the wire sections.

As may be seen from FIG. 4, the beginning of each of said saw-tooth wire sections 25 and the end of an adjacent saw-tooth wire section lie within the same diameter plane.

Figure 5:
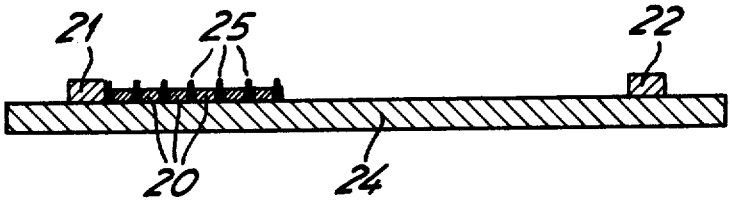
FIG. 5 is a cross-sectional view of the carding element of FIG. 4 taken along line IV—IV.

As may be seen from FIG. 5, which is a cross-sectional view taken along the line IV-IV of FIG. 4, the tips of the saw-tooth wire sections 25 protrude from the profiled wire sections 20.

Carding elements as shown in FIG. 4 and 5, in which profiled wire sections void of teeth are interposed between adjacent saw-tooth wire sections have proved to be advantageous when cooperating with the licker-in or in cooperation with the main cylinder when immediately following the licker-in.

It is within the scope of the invention to provide each of the cylinders of a carding machine with one or more of the carding elements as claimed in the following claims.

We claim:

1. In a carding machine having a main cylinder with saw-tooth wire wound therearound and at least three carding elements each comprising a plurality of saw-tooth wire sections arranged in parallel relationship on a fixed support and forming a card clothing cooperating with said main cylinder, the improvement wherein the saw-tooth wire sections of a first and second of said carding elements are positioned at an acute angle with respect to a diameter plane of said main cylinder with the pitch of the wire sections of said first carding element in a direction opposite that of the pitch of the wire sections of said second carding element, and wherein the saw-tooth wire sections of said third carding elements are positioned parallel to a diameter plane of said main cylinder.

2. A carding machine according to claim 1, wherein the direction of pitch of the saw-tooth wire sections of said first carding element is opposite that of the saw-tooth wire wound around said main cylinder.

3. A carding machine according to claim 1 wherein the pitch of the saw-tooth wire sections of each of said carding elements differs from the pitch of the saw-tooth wire wound around said main cylinder.

4. A carding machine according to claim 1 further comprising toothless profiled wire sections inserted between adjacent saw-tooth wire sections on each said carding element.

5. A carding machine according to claim 1 wherein the pitches of the saw-tooth wire sections of each of said first and second carding elements result in consecutive ends of adjacent saw-tooth wire sections lying in the same diameter plane.

6. In a carding machine having a main cylinder with saw-tooth wire wound therearound and at least three carding elements each comprising a plurality of saw-tooth wire sections arranged in parallel relationship on a fixed support and forming a card clothing cooperating with said main cylinder, the improvement wherein the saw-tooth wire sections of a first and second of said carding elements are positioned at an acute angle with respect to a diameter plane of said main cylinder with the pitch of the wire sections of said first carding element in a direction opposite that of the pitch of the wire sections of said second carding element, the saw-tooth wire sections of said third carding element are positioned parallel to a diameter plane of said main cylinder, the direction of pitch of the saw-tooth wire sections of said first carding element is opposite that of the saw-tooth wire wound around said main cylinder, and the pitch of the saw-tooth wire sections of each of said carding elements differs from the pitch of the saw-tooth wire wound around said main cylinder.

* * * * *